US007954342B2

(12) United States Patent
Devagnanam

(10) Patent No.: US 7,954,342 B2
(45) Date of Patent: Jun. 7, 2011

(54) FLEXIBLE KNITTING PIN

(76) Inventor: Theophilus Arputharaj Devagnanam, Tamil Nadu (IN)

( * ) Notice: Subject to any disclaimer, the term of this patent is extended or adjusted under 35 U.S.C. 154(b) by 503 days.

(21) Appl. No.: 11/991,202

(22) PCT Filed: Oct. 23, 2006

(86) PCT No.: PCT/IN2006/000417

§ 371 (c)(1),
(2), (4) Date: Feb. 28, 2008

(87) PCT Pub. No.: WO2007/049300

PCT Pub. Date: May 3, 2007

(65) Prior Publication Data

US 2010/0218561 A1 Sep. 2, 2010

(30) Foreign Application Priority Data

Oct. 28, 2005 (IN) ..... 1571/CHE/2005

(51) Int. Cl.
*D04B 35/02* (2006.01)

(52) U.S. Cl. ..... 66/117

(58) Field of Classification Search ..... 66/116, 66/117, 118

See application file for complete search history.

(56) References Cited

U.S. PATENT DOCUMENTS 1,966,690 A * 7/1934 Van Bergen ..... 66/117
2,045,267 A * 6/1936 Graham ..... 66/117
2,093,631 A * 9/1937 Burnham ..... 66/117
2,094,262 A * 9/1937 Burnham ..... 66/117
2,183,791 A * 12/1939 Dunn ..... 66/117
2,208,124 A * 7/1940 Dunn ..... 66/117
2,230,495 A * 2/1941 Kohlmann ..... 66/117
2,462,473 A * 2/1949 Delaney ..... 66/117
2,507,174 A * 5/1950 Phillips ..... 66/118
2,633,720 A * 4/1953 Robbins ..... 66/117
2,695,506 A * 11/1954 Kohlmann ..... 66/117
4,007,610 A * 2/1977 Linstead ..... 66/117
4,341,094 A * 7/1982 Heide ..... 66/117
4,494,387 A * 1/1985 Phipps et al. ..... 66/117
4,553,410 A * 11/1985 Okada ..... 66/117
4,646,543 A * 3/1987 Okada ..... 66/117
4,680,947 A * 7/1987 Phipps et al. ..... 66/117
4,693,094 A * 9/1987 Kahn ..... 66/117
5,720,187 A * 2/1998 Matuo ..... 66/117
6,983,627 B1 * 1/2006 Eley-Holden-Sotnik ..... 66/117
7,117,693 B1 * 10/2006 Nova ..... 66/117

FOREIGN PATENT DOCUMENTS

FR 2 043 032 2/1971
GB 876144 8/1961
GB 2 231 589 11/1990

* cited by examiner

*Primary Examiner* — Danny Worrell

(74) *Attorney, Agent, or Firm* — Ladas & Parry LLP

(57) ABSTRACT

A flexible knitting pin consisting of two relatively stiff shanks (1) pointed one end each, wherein said shanks (1) are connected with each other by the other end with a flexible hollow connecting material (2) comprising a joint; said joint between the stiff shanks (1) characterized in that it comprises a flexible hollow connecting material.

7 Claims, 3 Drawing Sheets

FLEXIBLE KNITTING PIN

FIELD OF THE INVENTION

The present invention relates to flexible knitting pin, specifically circular knitting pin made from any material. Accordingly, a method to realize this invention is also provided.

BACKGROUND OF THE INVENTION

Conventional knitting pins are known to have metal shanks comprising of a nylon monofilament. The step formed at the junction, usually prepared from nylon monofilament is not smooth and therefore, the step catches the wool. This results in obstructed functioning of the knitting pin.

British patent GB876144 describes circular knitting pins of two relatively stiff metal end parts joined by a flexible connection made from a polymer plastics material. The flexible connecting tube is joined to the end parts by making axial bores in the undrawn end portions of the flexible connection made from a length of moulded or extruded plastic material, inserting the surface roughened spigots into the axial bores of the flexible connection while supplying sufficient heat to the junctions to cause the end parts and the connections to become fixed together and further elongating and reducing in cross-section the intermediate portion of the flexible connection until further elongation is strongly resisted.

SUMMARY OF THE INVENTION

The present invention relates to a flexible knitting pin consisting of two relatively stiff shanks (1) pointed at one end each, wherein said shanks are connected with each other by the other end with a flexible hollow connecting tube (2) comprising a joint (x); said joint between the stiff shanks (1) and the flexible hollow connecting tube (2) consisting of a metal sphere, hemisphere or cone positioned inside the hollow connecting tube (2) at a fixed position up against the end of the stiff shank.

The invention also provides a method for the manufacture of the flexible knitting pin.

DETAILED DESCRIPTION OF THE INVENTION

The present invention relates to a flexible knitting pin, specifically, circular knitting pin made from any material which enables smoother movement of stitches compared to the prior art and is easier to use. Also, the method of realizing this invention is relatively simple while maintaining the same functionality.

The knitting needle consists of two stiff shanks which are pointed at one end and suitably machined for attachment at the other. These shanks are then connected to each other using a flexible tube.

Thus the product consists of two stiff shanks, suitably pointed at one end each for knitting and connected from the other end using a flexible hollow tube. The joint between the stiff shanks and the flexible hollow connecting tube consists of a metal sphere, hemisphere or cone positioned inside the hollow connecting tube at a fixed position up against the end of the stiff shank. The joint between the stiff shanks and the hollow flexible connecting tube is extremely smooth to enable the individual stitches to slide over the connection without impairment and without the yarn snagging at the connection.

Another aspect of the invention is the method to realize this invention. The two stiff shanks of the knitting needle are made from plastic, metal or wood. The joint between the stiff shanks and the flexible hollow connecting tube is made by insertion of a metal sphere, hemisphere or cone into the hollow connecting material in such a way that the ball rests against the flat end of the stiff shank.

In a preferred embodiment, the shank is made of rose wood whereas the hollow flexible connecting tube is made of polyurethane. At one end of the shank is a ferrule made of brass which holds a ball head screw made of brass. To enable a smooth transition between the shank and the hollow flexible connecting material, an adaptor made of brass has been put at the joint.

In another embodiment of the invention, a method for the manufacture of the flexible knitting pin is provided. The shanks are manufactured by conventional manufacturing processes. The attachment to the flexible material is the substance of the invention. The flexible material used is in the form of a polyurethane tube. This polyurethane tube is connected to the rigid shanks using a brass adaptor, a ball headed screw and a threaded ferrule.

The joint itself is made up of brass parts which are attached to the wooden shank and to the polyurethane flexible tube. The brass ferrule and adaptor are manufactured by conventional turning processes using automatic lathes. They are fashioned from brass rod. These parts are then lacquered to prevent tarnishing. The tolerances are such that they meet the requirements of the product and the joint.

The ball headed screw is manufactured, out of brass rod, in a two stage operation. The first stage is a standard turning operation carried out on automatic lathes. The second stage is a stamping operation which is carried out on a special purpose machine built and designed by the applicant. After the second operation, the screw is lacquered to prevent tarnishing.

The rigid shanks are made with the back end (the end that is not pointed) finished to a diameter suited to the inner diameter of the brass adaptor. The head of the ball headed screw is inserted into the polyurethane tube.

The threaded portion of the ball headed screw is attached to the adaptor either directly, or using the ferrule (depending upon the size of knitting pin).

Adhesive is applied to the threaded portion to ensure that it locks tight. The adaptor carrying the ball headed screw, ferrule and attached to the polyurethane tube is then fastened to the shank with the use of an adhesive.

The above method results in an extremely smooth joint between the rigid shank and the flexible tube.

DETAILED DESCRIPTION OF THE ACCOMPANYING DRAWINGS

FIG. 1 illustrates a perspective schematic view of the present invention. The two relatively stiff ends of the pin are denoted by 1 whereas the hollow flexible connecting tube between the two pins is denoted by 2. The shank is made from rosewood whereas the hollow flexible connecting tube is made from polyurethane.

Figure 1:
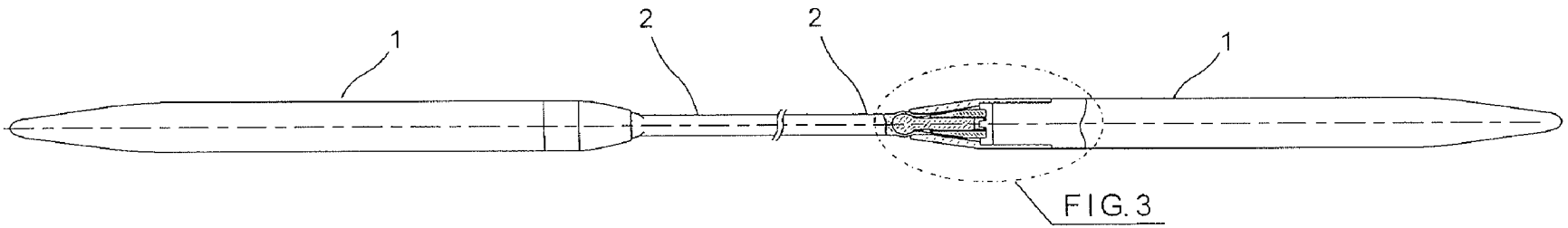
Figure 2:
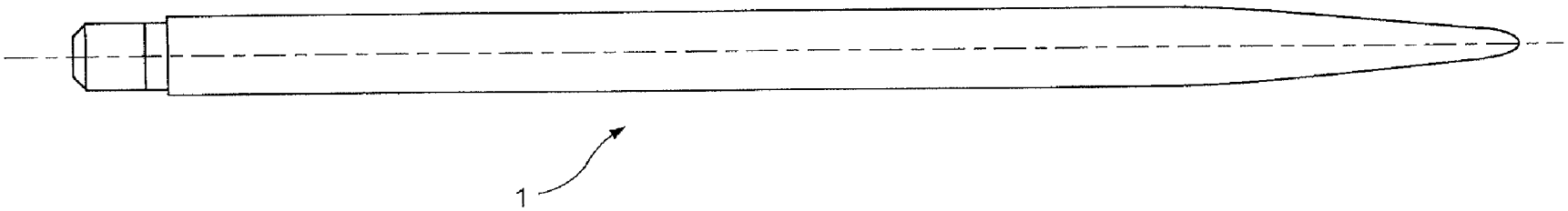
FIG. 2 illustrates one of the ends of the pin or shank which is pointed at one end and the other end forms a joint with the hollow flexible connecting tube.
Figure 3:
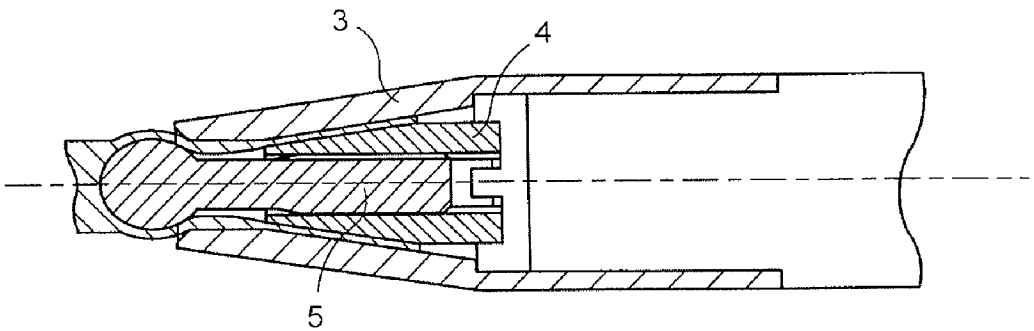
FIG. 3 illustrates the junction between the shank and the hollow flexible connecting tube where the assembly of adaptor (3), ferrule (4) and the ball screw head (5) is shown in detail.
Figure 4:
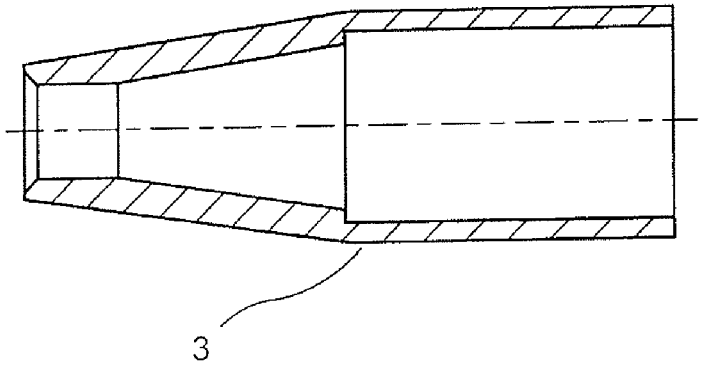
FIG. 4 illustrates the adaptor (3) which provides a smooth transition between the hollow flexible connecting material and the shank. The adaptor is made from brass.
Figure 5:
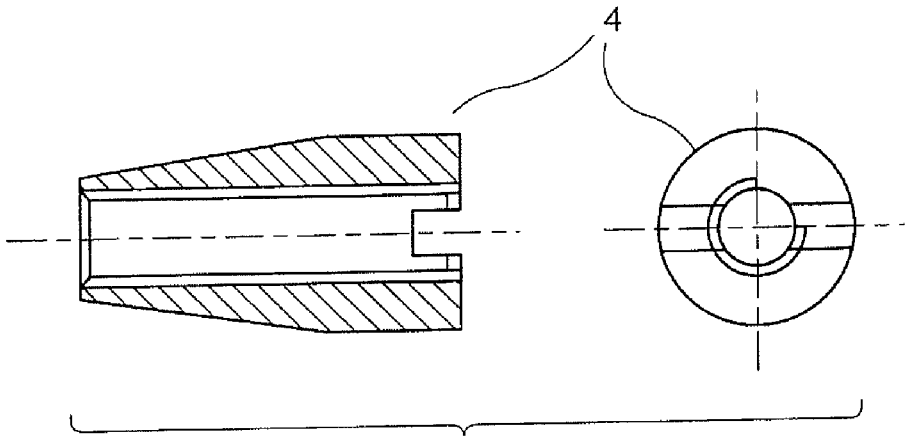
FIG. 5 depicts the ferrule (4) which holds the ball head screw in place. The ferrule is made from brass.
Figure 6:
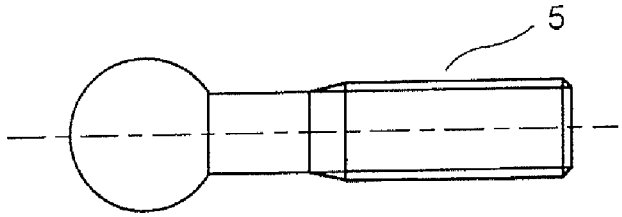
FIG. 6 illustrates the ball head screw (5). The screw is made of brass.

Various modifications and alterations of this invention will become apparent to those skilled in the art without departing from the scope and spirit of this invention and it should be understood that this invention is not unduly limited to the illustrative embodiment set forth herein.

The invention claimed is:

1. A flexible knitting pin comprising two relatively stiff shanks each having a pointed end and a back end;

a flexible hollow connecting material and a joint having a brass adaptor carrying a ferrule and a ball headed screw;

wherein the shanks are connected together by the back ends via the flexible hollow connecting material and the joint;

and wherein the ferrule is attached to the back end of the shank, a threaded portion of the screw is attached to the ferrule and a sphere portion of the screw is inserted into the flexible hollow connecting material to provide a smooth transition between the shank and the flexible hollow connecting material.

2. A flexible knitting pin as claimed in claim 1 wherein the ferrule and ball headed screw are made of brass.

3. A flexible knitting pin as claimed in claim 1 wherein the flexible hollow connecting material is a flexible hollow tube.

4. A flexible knitting pin as claimed in claim 1 wherein the stiff shanks are made from plastic, metal or wood.

5. A flexible knitting pin as claimed in claim 1 wherein the shank is made of rose wood and the hollow flexible connecting material is made of polyurethane.

6. A method of producing a flexible knitting pin as claimed in claim 1 comprising the steps of;

finishing the back end of the shank to a diameter suited to the inner diameter of the brass adaptor;

inserting the sphere portion of the ball headed screw into the hollow flexible connecting tube;

attaching the threaded portion of the screw to the adapter via the ferrule using an adhesive;

and fastening the adapter to the back end of the shank using an adhesive.

7. A method of knitting comprising a) providing the flexible knitting pin as claimed in claim 1; and b) knitting yarn with the flexible knitting pin with formation of individual stitches that slide over the smooth transition without impairment and without yarn snagging on the transition.

* * * * *